United States Patent [19]

Okawara et al.

[11] 4,035,209

[45] July 12, 1977

[54] METHOD OF PREVENTING DETERIORATION BY HEAT

[75] Inventors: Kenjiro Okawara; Sigeru Itakura; Teruo Matsui; Toshio Nakajima, all of Yokohama, Japan

[73] Assignee: Tokai Metals Co., Ltd., Japan

[21] Appl. No.: 594,773

[22] Filed: July 10, 1975

Related U.S. Application Data

[63] Continuation-in-part of Ser. No. 371,522, June 19, 1973, abandoned.

[30] Foreign Application Priority Data

June 20, 1972 Japan ..... 47-61568

[51] Int. Cl.[2] ..... C23F 1/00; C25D 5/44

[52] U.S. Cl. ..... 156/3; 156/279; 156/665; 204/33; 51/319; 427/192; 427/309; 428/164; 428/328; 428/920

[58] Field of Search ..... 427/192, 290–292, 427/309; 156/3, 6, 21, 22, 279, 280; 204/33; 428/164, 328, 920, 921

[56] References Cited

U.S. PATENT DOCUMENTS

| | | | |
|---|---|---|---|
| 1,565,495 | 12/1925 | Pfeil | 427/192 |
| 1,844,512 | 2/1932 | Mains | 428/164 |
| 2,079,516 | 5/1937 | Lilienfeld | 156/22 X |
| 3,039,904 | 6/1962 | Stage | 156/280 X |
| 3,077,659 | 2/1963 | Holzwarth et al. | 427/292 X |
| 3,249,523 | 5/1966 | Post et al. | 156/22 X |

*Primary Examiner*—William A. Powell

*Attorney, Agent, or Firm*—Oblon, Fisher, Spivak, McClelland & Maier

[57] ABSTRACT

Substrate materials are prevented from deteriorating from exposure to intense heat by protecting the substrate with aluminum foil having at least one surface thereof roughened and subjecting said substrate to heat. The foil is capable of resisting temperatures in excess of 1,000° C.

9 Claims, 5 Drawing Figures

METHOD OF PREVENTING DETERIORATION BY HEAT

CROSS REFERENCE TO RELATED APPLICATIONS

This application is a continuation-in-part of application Ser. No. 371,522, filed June 19, 1973, now abandoned.

BACKGROUND OF THE INVENTION

1. Field of the Invention

This invention relates to a heat resistant material. More particularly, the invention relates to a heat resistant material which utilizes an aluminum foil or an aluminum alloy foil.

2. Description of the Prior Art

Since aluminum foil or aluminum alloy foils have very bright metallic surfaces, they have substantial heat insulating properties. However, since the melting point of aluminum is 660° C when the foil is exposed to a source of heat over this temperature, the aluminum melts and leaves holes in the surface of the foil. As a result, the foil loses its heat resisting and insulating effects.

A need, therefore, exists for an aluminum or an aluminum alloy foil which does not melt and lose its heat insulating and resistant properties when exposed to temperatures over the melting point of aluminum.

SUMMARY OF THE INVENTION

Accordingly, one object of the present invention is to provide a heat resistant material which is capable of enduring temperatures greater than the melting point of aluminum.

Another object of the present invention is to provide a heat resistant material which is capable of sufficiently enduring temperatures over 1000° C.

Yet another object of the present invention is to provide a heat resistant material of an aluminum or an aluminum alloy foil, wherein one or both of the surfaces of the foil have been etched or roughened to improve the heat resistant and insulating properties of the foil, Briefly, these objects and other objects of the invention as herein after will become more readily apparent can be attained by a method of preventing deterioration of materials from intense heat by protecting a substrate with aluminum foil having at least one surface thereof roughened and subjecting the substrate to heat.

BRIEF DESCRIPTION OF THE DRAWINGS

A more complete appreciation of the invention and many attendant advantages thereof will be readily obtained as the same becomes better understood by reference to the following detailed description when considered in connection with the accompanying drawings, wherein.

BESCRIPTION OF THE PREFERRED EMBODIMENTS

Figure 1:
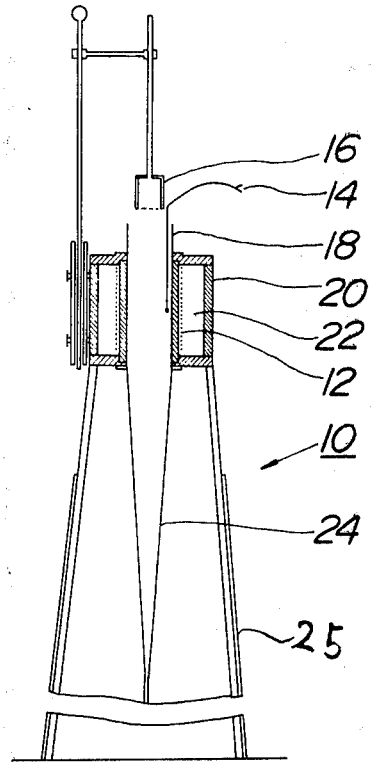
FIG. 1 is a schematic view of a heating furnace used in the backing test of the heat resisting material of the present invention.

The aluminum foil or aluminum alloy which is suitable for the present invention, is a foil which has a thickness of 8 to 200 microns. The powder which is applied to the foil may be of any shape, and preferably has a particle size in the range of 5–200 microns.

When at least one of the surfaces of the aluminum or aluminum alloy foil is to be roughened by chemical etching, preferably the foil is etched in an acid solution of hydrochloric acid, nitric acid, aqua regia, or the like, or a basic solution of aqueous sodium hydroxide, or potassium hydroxide at 60° to 90° C for 30 seconds to 1 minute depending on the etchant used.

When the foil is electrolytically etched, a D.C. or A.C. current is used to etch the aluminum foil or aluminum alloy foil, in an electrolyte of hydrochloric acid. The aluminum or aluminum alloy foil is used as the positive electrode and carbon is used as the negative electrode in the electrolytic cell. Preferably a current density of approximately 30 amperes/100 $cm^2$ is impressed across the electrodes in an electrolytic bath at a temperature of 60° to 90° C for 30 seconds to 1 minute.

When the foil is mechanically roughened on at least one of its surfaces, an abrasive means such as sand paper, sand blasting, a nylon brush, or the like is used. Preferably, the treated surface(s) or the aluminum or aluminum alloy is roughened uniformly so as to reduce the weight of the foil from 10 to 40% of its original weight.

The aluminum or aluminum alloy foil which has been roughened by being chemically or electrolytically etched or mechanically roughened is capable of enduring temperatures in excess of 1000° C. However, it has been found that the heat resisting endurance of the foil can be further improved by applying a fine aluminum powder onto one or both of the treated surfaces of the foil. Various shapes and sizes of the fine aluminum powder granules may be used to coat the foil.

In order to fixedly attach the fine aluminum powder onto at least one of the surfaces of the aluminum or aluminum alloy foil, the fine aluminum powder is mixed with a suitable binder such as, silicon resin varnish, alkyl resin varnish, spar varnish, butyl titanite resin varnish, or the like or with a suitable solvent such as xyloyl, triols, fatty acid esters, or the like. If deemed necessary, other components such as a fire-proofing agent can be coated onto the foil. The mixture containing the fine aluminum powder can be coated onto the foil. The thickness of the fine aluminum powder layer may be in excess of approximately 2 microns.

The reason why the aluminum or aluminum alloy foils of this invention are able to resist heat to the extent that they do is not yet clearly understood. It is known, however, that the heat resistant properties of the material obtained by the method of the invention as illustrated in the following Examples do not change at all even when placed in contact with a heat source having a temperature over 1000° C.

Because of the improved heat resisting properties exhibited by the foil of the present invention the foil may be used alone or it may be used as a refractory material and applied to structural materials such as wood, plywood, stone, gypsum, asbestos, cement, or the like which are common materials that are easily cracked by heat.

EXAMPLE 1

Chemical etching

A series of aluminum foils with thicknesses of 30, 50, 70, 100 and 150 microns were immersed and etched in 5 to 20%-hydrochloric acid solutions at 60° to 90° C for 30 seconds to 1 minute. A series of heat resistant foils were obtained by the procedure.

EXAMPLE 2

Electrolytic etching

A series of aluminum foils with thicknesses of 30, 50, 70, 100, and 150 microns were electrolytically etched as follows.

Electrolyte: 5 to 20%-hydrochloric acid solution
Electrodes:
Positive: aluminum foil
Negative: carbon
Current density: 30 amperes/100 $cm^2$
Etching time: 30 seconds to 1 minute
Temperature: 60° to 90° C.

Suitable heat resistant aluminum foils were obtained by this procedure.

EXAMPLE 3

Mechanical surface roughening treatment

A series of aluminum foils with thicknesses of 30, 50, 70, 100 and 150 microns were uniformly roughened on the surfaces thereof by sand paper, sand-blasting, or a nylon brush until the weight of the foil was reduced by 30%. A series of suitable heat resisting foils were obtained by this procedure.

EXAMPLE 4

Application of fine aluminum powder to the foil

A composition of 12 parts of a mixture of fine aluminum powder and mineral spirits in a ratio of 65 to 35, 32 parts silicon varnish, and 4 parts xyloyl was coated onto a surface of a foil treated by the procedure of Examples 1 to 3 to a thickness of 2 microns. A suitable heat resistant foil was obtained by this procedure.

EXAMPLE 5

Backing test

Three sheets of aluminum foils A, B and C, 0.100 mm thick each having the areas shown below and of a size of 250g/$m^2$ were treated according to the method of the present invention on both surfaces of the foils by fixedly attaching 0.02 mm particles of fine aluminum powder onto both surfaces thereof. Silicon resin varnish was mixed with the aluminum powder as a binder in the amount of 38.2g/$m^2$ plus a pigment in the amount of 3.8g/$m^2$.

| Number: | A | B | C |
|---|---|---|---|
| Size (mm): | 220 × 221 | 221 × 221 | 220 × 221 |
| Thickness (mm): | 0.15 | 0.15 | 0.15 |
| Weight (g): | 16.9 | 16.4 | 16.4 |

The heat resisting aluminum foils thus treated were placed in a good ventilating room for more than one month, were dried in a drying device maintained at 35° to 45° C. for more than 120 hours, and were then placed in a desiccator for more than 24 hours.

The samples of the aluminum foil were placed in a heating furnace for backing tests as shown in FIG. 1. The temperature was adjusted to 750° ± 10° C and a stable temperature was maintained over 20 minutes before the test specimens were placed into the furnace.

In FIG. 1, the heating furnace 10 had a heat source such as an electric heating wire 12 equipped with a constant voltage regulator (not shown), a thermocouple 14 for measuring the temperature in the furnace 10 and disposed as shown in the center of the furnace 10 at a height along the wall of the furnace 10 at a distance of 1 cm from the inner surface of the wall of the furnace at the thermocouple junction, a specimen container 16, a wind shield cylinder 18 inserted into the furnace from above, a vertical cylindrical refractory material 20 forming an electric furnace body 22, a conical air ventilation stabilizing cylinder 24 inserted into the furnace from the bottom, and a draft shield cylinder 25 mounted underneath the furnace body 22. This heating furnace 10 was so constructed as to maintain a furnace temperature of 750° ± 10° C for more than 30 minutes as measured by the thermocouple 14 disposed as indicated above and defined as below:

Construction of Thermocouple 14

Material:
plus leg: alloy consisting mainly of nickel chrome steel
minus leg: alloy consisting mainly of nickel-aluminum-manganese
Size of wires: 0.65 ± 0.03 mm in diameter
Measuring allowance:
400° – 650° C.: ± 0.75%
0° – 400° C.: ± 3°

The thermocouple 14 was used together with an electron tube automatic balanced recording thermometer (not shown) having the following specifications:
Number of scale divisions on paper: 30 – 200
Allowance of recording paper scale: ±1.0%
Allowance of non-sensitive range: 0.1%
Allowance of indication: 0.5%

The test aluminum foil specimens A, B and C treated as above were each tested by heating them at the adjusted temperatures shown below in the heating furnace 10 for more than 20 minutes after they were inserted into the specimen container 16 of the heating furnace 10 and were then positioned so that the center line of the side surface of the test specimen aligned with the thermocouple junction of the thermocouple 14 in order to measure the temperature in the furnace 10.

| Number: | A | B | C |
|---|---|---|---|
| Adjusted temperature: | 749° C. | 750° C. | 755° C. |

The test results of specimens A, B and C, the relationship between the maximum temperature in the furnace and the lapsed time, temperature differences, and weight reductions of the specimens are shown below.

| Number | A | B | C |
|---|---|---|---|
| Max. Temp. of | | | |

-continued

| Number | A | B | C |
|---|---|---|---|
| furnace: | 790 | 798 | 794 |
| Temp. difference: | 41 | 48 | 39 |
| Weight reduction: | 3.6% | 0.7% | 0.9% |

From the foregoing results it is clear that the temperature difference in all the test data did not exceed 50° C over the adjusted temperature in the furnace.

EXAMPLE 6

Surface test

The same test specimens A, B and C were tested on the surfaces thereof as follows:

The test specimens of aluminum foil were placed in a good ventilating room for more than one month, were dried in a drying device maintained at 35° to 45° C for more than 24 hours, and were then placed in a desiccator for more than 24 hours.

Figure 2A:
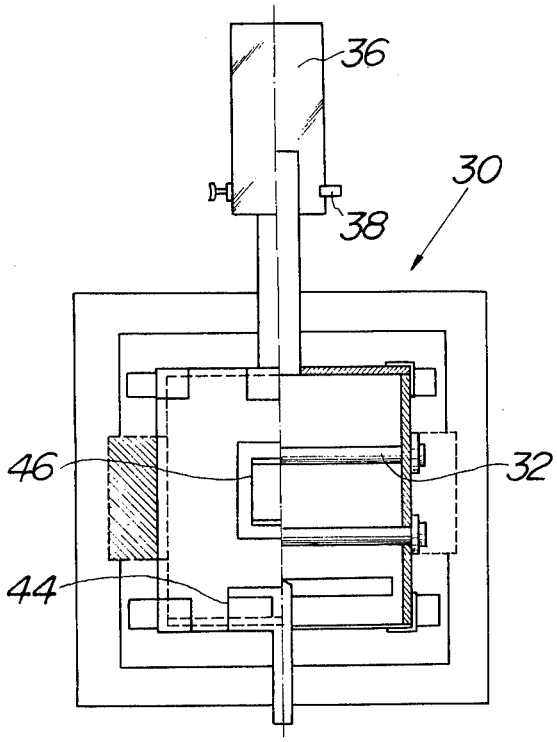
FIGS. 2A and 2B are front and side views of a heating furnace used in the surface test of the heat resisting material of the present invention.
Figure 2B:
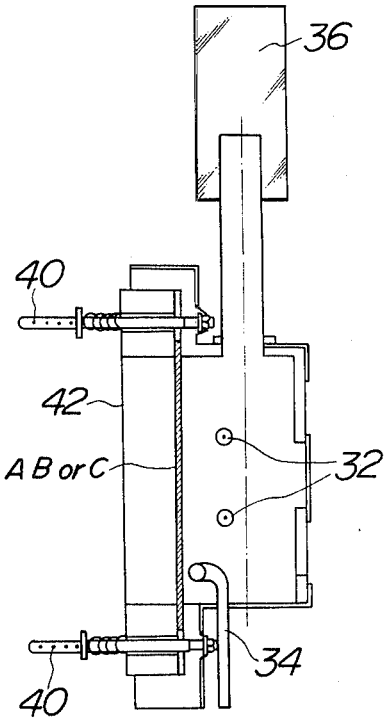

As shown in FIGS. 2A and 2B, a heating furnace 30 was used to heat the test specimens. The furnace had a main heat source of 1.52 kw/hour such as an electric heating wire 32 having a constant voltage regulator (not shown), a sub heat source such as a gas burner 34 using town gas ejected at a rate of 1.50 liter/min., an exhaust gas outlet 36 mounted on the top of the furnace 30, a thermocouple 38 mounted at the junction thereof with the exhaust gas outlet 36, for measuring the temperature of the exhaust gas of the heating furnace 30, specimen A, B or C mounted by fittings 40 in the furnace 30, a back cover 42 mounted over the specimen, an air inlet 44, and an observation window 46. The heating furnace 30 was constructed so that the temperature of the exhaust gas could be reproduced within a range of error of 20° C as shown in Table 1 with respect to the lapsed time when the furnace 30 is heated by the sub heat source 34 for 3 minutes and is then heated by both the main and sub heat sources 32 and 34 for 7 minutes, using a standard plate made of 0.8 asbestos pearlite and sized at 22 cm X 22 cm X 1 cm and treated as above and cured in an autoclave.

Table 1

| Lapsed time (min.) | 1 | 2 | 3 | 4 | 5 | 6 | 7 | 8 | 9 | 10 |
|---|---|---|---|---|---|---|---|---|---|---|
| Temp. of exhaust gas (° C.) | 70 | 80 | 90 | 155 | 205 | 235 | 260 | 275 | 290 | 305 |

Figure 3:
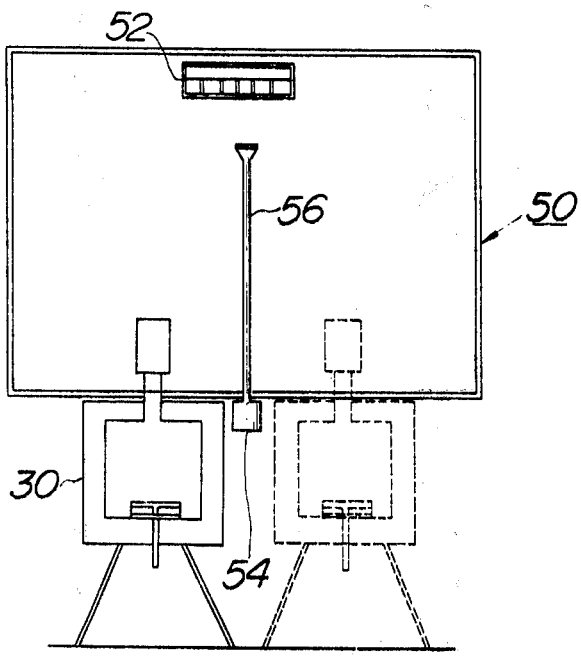
FIG. 3 is a schematic view of a rectangular fume collecting box used to measure the amount of fumes envolved while testing the heat resisting material of the present invention.

In order to measure the amount of fumes evolved in the heat treatment (fuming coefficient per unit area), a rectangular fume collecting box 50 was mounted on the heating furnace 30, and was sized at 1.41m X 1.41m X 1m (height) inside. A fume agitating device 52 was mounted therein and a light measuring device 54 having a fume chimney 56 was provided underneath the fume collecting box 50. The fume chimney 56 projected through the bottom of the fume collecting box 50 as shown in FIG. 3.

Figure 4:
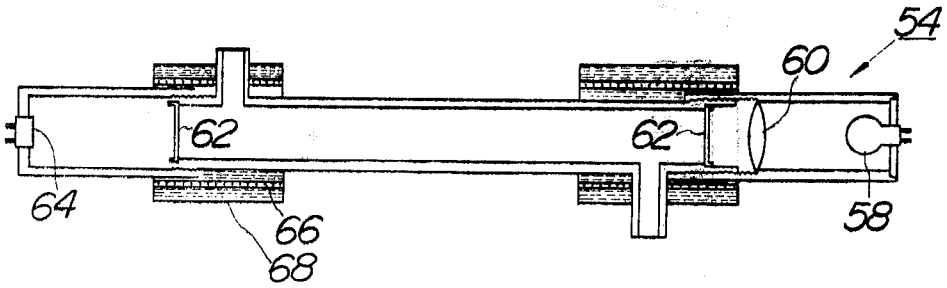
FIG. 4 is a schematic view of a light measuring device used for testing the heating resisting material of the present invention.

The light measuring device 5 was constructed, as shown in FIG. 4. The device measuring fumes flowing therethrough at a rate of 1.5 l/min, and was positioned 30 cm below the top center of the fume collecting box 50. The device also had a light source such as an incandescent lamp 58, provided at one side end, a lens 60, a pair of glass plates 62 which shielded the lamp 58 and lens 60 from the fumes, a photosensitive cell 64, electric heating wires 66, and insulating glass fibers 68 surrounded around the electric heating wires 66 disposed about the inlet and outlet of the fume.

Construction of thermocouple 38 (FIG. 2A)

Material: the same as that of thermocouple 14 (FIG. 1)

Size of wires: 1.60 ± 0.05 mm in diameter

Measuring allowance:

400° – 850° C.: ±0.75%

0° – 400° C.: ±3°

Thermocouple 38 was used together with the electron tube automatic balanced recording thermometer (not shown) used in Example 5 to measure the temperature of the exhaust gas from the heating furnace 30.

The test aluminum foil specimens A, B and C treated as above were, respectively, tested by first heating the same with the sub heat source 34 for 3 minutes and then heating the samples with both the main and sub heat sources 32 and 34 for 7 minutes. After the heating treatments, furnace 30 was heated by the sub heat source 34 for 3 minutes and was then heated by both the main and sub heat sources 32 and 34 for 7 minutes using the standard plate described above. The back cover 42 was then removed so that the temperature indicated by the thermocouple 38 was lowered to about 50° C.

The light passing through the fumes was measured every 15 seconds during the heating test.

The test results obtained for specimens A, B and C are shown below:

| Number: | A | B | C |
|---|---|---|---|
| Temp. × time area (° C. min.) | 0 | 0 | 0 |
| Fumes per unit area | 2 | 0 | 0 |
| Time of residual flame (sec.) | 0 | 0 | 0 |
| Length and width of melted area and cracks in foil | none | none | none |
| Harmful deformation in fire-proof | none | none | none |
| Harmful gases | none | none | none |
| Rear space temp. (° C.) | 401 | 405 | 400 |

The Temp. X time area designation in the table above means the area surrounded by the curve of the temperature of the exhaust gas of the test specimens which exceeds the curve of the temperature of the exhaust gas using the above standard plate and the curve of the temperature of the exhaust gas of the standard plate.

The amount of fumes per unit area (CA) is obtained by the following formula:

$$CA = 240 \log_{10}(Io/I)$$

wherein $Io$ represents the intensity of light (lux) from the time heating is started in the heating furnace, and $I$ represents the minimum value of the light intensity (lux) during the heating test in the heating furnace.

Having now fully described the invention, it will be apparent to one of ordinary skill in the art that many changes and modifications can be made thereto with-out departing from the spirit or scope of the invention as set forth herein.

What is claimed as new and desired to be secured by Letters Patent of the United States is:

1. In a method of preventing the deterioration of a heat deterioratable material from exposure to intense heat, wherein said material is protected by an aluminum foil, the improvement wherein said aluminum foil has both surfaces roughened to an extent whereby 10–40 wt.% of the original aluminum foil has been removed and wherein each roughened surface has bonded thereto a layer of fine aluminum particles less than 2 microns in thickness such that said material is protectable against heat conditions above the normal melting point of aluminum foil.

2. The method of claim 1, wherein said foil is roughened by chemically etching with an acidic solution at 60° to 90° C for 30 seconds to 1 minute.

3. The method of claim 1, wherein said foil is roughened by subjecting said foil to a DC or AC current in an electrolytic solution of hydrochloric acid at 60° to 90° C for 30 seconds to 1 minute.

4. The method of claim 1, wherein said foil is 8–200 microns thick.

5. The method of claim 1, wherein said foil is roughened by sand blasting.

6. The method of claim 1, wherein said foil is roughened by sand paper.

7. The method of claim 1, wherein said foil is roughened by a nylon brush.

8. The method of claim 1, wherein aluminum powder is bound to said roughened foil by use of a binder selected from the group consisting of silicon resin varnish, alkyl resin varnish, spar varnish and butyl titanite resin varnish.

9. The method of claim 8, wherein said aluminum powder and binder are applied to said foil in a solvent selected from the group consisting of xylol, triols, and fatty acid esters.

* * * * *